US008804297B2

(12) United States Patent
Blitshteyn et al.

(10) Patent No.: US 8,804,297 B2
(45) Date of Patent: Aug. 12, 2014

(54) OPTIMIZED ELECTROSTATIC PINNING AND/OR CHARGING

(75) Inventors: Mark Blitshteyn, Alameda, CA (US); Edward Anthony Oldynski, Martinez, CA (US)

(73) Assignee: Illinois Tool Works Inc., Glenview, IL (US)

( * ) Notice: Subject to any disclaimer, the term of this patent is extended or adjusted under 35 U.S.C. 154(b) by 212 days.

(21) Appl. No.: 13/635,215

(22) PCT Filed: May 5, 2010

(86) PCT No.: PCT/US2010/001327

§ 371 (c)(1),
(2), (4) Date: Sep. 14, 2012

(87) PCT Pub. No.: WO2011/115605

PCT Pub. Date: Sep. 22, 2011

(65) Prior Publication Data

US 2013/0008584 A1 Jan. 10, 2013

Related U.S. Application Data

(60) Provisional application No. 61/340,603, filed on Mar. 19, 2010.

(51) Int. Cl.
*B29C 65/14* (2006.01)
*B41J 2/41* (2006.01)

(52) U.S. Cl.
CPC ..... *B41J 2/41* (2013.01)
USPC ..... 361/225

(58) Field of Classification Search
CPC ..... B41J 2/41; B29C 65/14; H02N 13/00; G03G 15/02; G03G 15/0216; G03G 15/0233; G03G 15/0266
USPC ..... 361/225
See application file for complete search history.

(56) References Cited

U.S. PATENT DOCUMENTS

| | | | | |
|---|---|---|---|---|
| 5,062,764 | A * | 11/1991 | Welsch | 414/796 |
| 6,130,815 | A | 10/2000 | Pitel et al. | 361/212 |
| 6,674,630 | B1 | 1/2004 | Gefter et al. | 361/212 |
| 2006/0289692 | A1 * | 12/2006 | Horneck et al. | 242/535.4 |
| 2007/0229037 | A1 | 10/2007 | Hayashi | 320/127 |

OTHER PUBLICATIONS

PCT Application PCT/US 10/01327, Notification of Transmittal of the International Search Report . . . and associated International Search Report, mailed Jun. 24, 2010; 4 pages total.
PCT Application PCT/US 10/01327, Written Opinion of the International Searching Authority, mailed Jun. 24, 2010; 7 pages total.

* cited by examiner

*Primary Examiner* — Jared Fureman
*Assistant Examiner* — Kevin J Comber
(74) *Attorney, Agent, or Firm* — The Patent Source

(57) ABSTRACT

Electrostatic charging performance may be improved by determining a satiation charging current for objects/products passing through a charging system and then applying the determined satiation charging current the objects/products. Charging performance may be improved in either or both of discontinuous product train applications or continuous web applications.

20 Claims, 14 Drawing Sheets

OPTIMIZED ELECTROSTATIC PINNING AND/OR CHARGING

CROSS REFERENCE TO RELATED CASES

This application claims the benefit under 35 U.S.C. 119(e) of U.S. Provisional Application Ser. No. 61/340,603 filed Mar. 19, 2010 and entitled "Optimized Electrostatic Pinning And/Or Charging" which Provisional Application is hereby incorporated by reference.

BACKGROUND OF THE INVENTION

1. Field of the Invention

The present invention is directed to systems, methods, apparatus and related software to achieve improved electrostatic tacking and/or pinning. More particularly, the invention relates to charging systems and methods for applying optimally effective charge to objects such as discontinuous trains of printed matter and/or continuous ribbons. Accordingly, the general objects of the invention are to provide novel systems, methods, apparatus and software of such character.

2. Description of the Related Art

Electrostatic charging is used in several manufacturing processes in commercial printing, including electrostatic ribbon tacking and stack tacking. Electrostatic ribbon tacking is the preferred method to meet increase speed and efficiency in folding and cutting processes. The technology uses an electrostatic charge to hold multiple ribbons together, making them behave like a single web and preventing the leading, side or trailing edges of the signature from "peeling away" from the signature package. This allows the electrostatically-bonded ribbons to be cut with the required precision, as the individual ribbon tensions are equalized. Electrostatic ribbon tacking enables the pressroom to deliver crisply folded signatures to the bindery without "dog-eared" edges at speeds of up to 3,000 ft/min.

Electrostatic charging of the type discussed herein may be achieved with at least one conventional charge applying device which may take the form of a charging bar configured to operate in conjunction with a grounded roller to charge objects and/or a continuous web (such as material for manufacturing gusseted bags) as they move through the charge applying device (i.e., between the charging bar and the grounded roller).

Electrostatic charging of the type discussed herein may also be achieved using a charge applying device that takes the form of two conventional charging bars (or other conventional ionizing electrodes known in the art) facing each other, one on each side of the multi-ribbon web or discontinuous product train. A dual-polarity high voltage charging power supply may apply a positive voltage to one bar and negative voltage to the other. Airborne ions of opposite polarity are produced by the opposing bars and stream between the charging elements of the charge applying device toward the web moving therebetween and causing all the ribbons to hold tightly together. FIG. 1 shows a charging system 100 with two possible locations for electrostatically pinning/tacking plural ribbons (or layers) together: after folding, downstream of the nips or before folding, near the roll at the top of the former. As is known in the art, the distance between the two elements of a charge applying means will typically range from about 0.5 inches and about 6 inches and the ionizing voltage will typically range from about 5 kV to about 60 kV (with 10 kV to 30 kV being the most common range).

Electrostatic stack tacking is used in compensating stackers where belts convey magazines up the stacker to be dropped into a compensator where they are stacked to varying heights that meet postal routing specifications. Magazine stacks must move quickly through the compensator to keep up with the upstream equipment. When the stacks are pushed onto the conveyor or rollers leading to a shrink wrap tunnel or other packaging equipment, the stack must stay straight and integral without shifting. However, magazines with UV-coated covers, either perfect bound or saddle stitched, have slippery surfaces that make them prone to shifting. In addition, high page count saddle-stitched magazines are challenging since the spine side is thicker than the open side and this can cause books to slide over toward the open side and "shingle over" as they exit the compensator.

Electrostatic force of attraction can preserve the neat stack or block achieved in the compensating stackers and this is generally known as incline stack-tacking. Incline tacking systems, such as system 100' of FIG. 2, typically use one charge applying device that includes a pair of charging bars, one placed above the magazine's path and the other placed below. The ionizing electrodes in the bars are normally aligned with and face each other. A positive voltage is applied to one bar and a negative voltage to the other using either a pair of high voltage charging generators (high voltage power supply) or a single dual-polarity power supply.

When the bars are energized with no products in the incline feeder, the opposite polarity air ions produced by the opposed bars will flow between the bars completing the electrical circuit. When magazines move between the bars, they interrupt this flow and ions of opposite polarity deposit on the front and back covers, leaving these surfaces oppositely charged. The moving products carry these charges away, as a "convection" electrical current, again completing the electrical circuit.

Magazines and other bound products formed of a plurality of sheets of material may be compressed by the electrostatic force between the front and back cover pages with the air being squeezed out. While that contributes to forming a neat integral stack, a secondary effect is most important. When a charged magazine is dropped into the stacker, it lands with its back cover on top of the front cover of the previous magazine. Opposing charges on the front cover of one magazine and the back cover of an adjacent magazine attract each other, causing the magazines to adhere to each other, as shown in stack 101 of FIG. 3. This attraction keeps the magazines from shifting when stack 101 is in motion.

The above-described use of conventional electrostatic charging systems can dramatically increase throughput rates. For example, production speeds on a Goss SP 2200 without incline tacking are typically only 175 to 200 per minute. When a conventional electrostatic charging system is properly installed in the feeder, however, throughput can exceed 300 books per minute. Nonetheless, further improvements and/or refinements to such systems are still possible.

SUMMARY OF THE INVENTION

The present invention satisfies the above-stated needs and overcomes the above-stated and other deficiencies of the related art by providing methods, systems and apparatus for achieving improved electrostatic charging in systems that determine a satiation charging current for the objects/products/webs to be charged and then apply a charging current, that is at least substantially equal to the satiation current, to the moving objects/products/webs. In this way, the inventive methods and apparatus reduce the inefficiencies customarily tolerated in tacking and/or pinning operations and may do so in either continuous ribbon/web or in discontinuous material flow applications. In a particularly preferred embodiment, the satiation charging current is a substantially constant charging current applied by at least one charge applying device to a discontinuous product train even though the impedance presented by the product train may vary significantly as products and gaps alternately move between the elements of the charge applying device.

In stack tacking applications, frictional forces between charged objects in a stack increase generally linearly with increasing Coulomb forces. Since the ability of a given object surface to carry charge is limited, however, the charge of a given object surface will substantially plateau when the surface is incapable of absorbing any more charge. As a consequence, the frictional forces between charged objects in a stack will also substantially plateau as charge saturation occurs. In accordance with the invention it has been newly determined that attempting to increase these frictional forces beyond that level will be largely ineffectual and result in substantial inefficiencies.

Also in accordance with the invention, it has been newly determined that the plateau of the Coulomb force may be detected by monitoring the charging current (as opposed to the charging voltage) applied to at least one moving object over the time that the object is charged. In particular it has been newly observed that, increasing and/or varying a charging voltage applied to the charge applying devices above an ionizing threshold level, may reveal a generally constant and unique value of charging current that reflects Coulomb force plateau. In accordance with the invention, we will refer to this charging current value as satiation charging current. This current represents the optimally effective charging current that may be applied to moving objects and may be substantially equal to that amount of current that will deposit substantially maximum charge on the surfaces of a product of a discontinuous product train in the time it takes the product to move through the charge applying device. Attempting to apply a charging current substantially above the satiation current value leads to little or no increase in the normal and/or blocking forces between charged objects in a stack. Conversely, attempting to apply a charging current substantially below the satiation current value fails to maximize the normal and/or blocking forces that may be efficiently created between charged objects in a stack.

Empirical data showing this effect is illustrated in the chart 208 of FIG. 4. Chart 208 was compiled from data generated by a test apparatus with a charging system similar to that shown in FIG. 2. During the test, magazines, flowing between the opposing charging bars at a constant rate, were charged and stacked using charging currents ranging from 0.2 mA to 1.0 mA (in 0.1 mA increments). For each stack the effectiveness of the blocking effect was tested by measuring a static friction force to determine the minimum force necessary to dislodge the top magazine off the stack. As shown in FIG. 4, it was empirically determined that, for these stacks of objects, the minimum dislodging force increased linearly with the charging current until it reached a plateau at a current of about 0.6 milliamps. Increasing the charging current from about 0.6 milliamps to about 1.0 milliamp (by increasing the ionizing voltage applied to the positive and negative charging bars) did not substantially increase the dislodging force. Accordingly, the satiation charging current of these objects was empirically determined to be about 0.6 mA.

In accordance with the invention, the satiation current may be determined by substantially raising the ionizing voltage applied to a charge applying device until the charging current from the charge applying device does not substantially increase. Alternatively, the satiation current may be determined by measuring the charging current from the charge applying device while substantially raising the ionizing voltage applied to a charge applying device. The satiation current may also be determined when the measured current does not increase or decreases in response to further increases in ionizing voltage. It may also be the measured current when the absolute value of the difference between two measured currents is less than a predetermined value.

The satiation charging current value for an individual moving object depends on the velocity of the object and the ability of the surface of the object to carry charge which is, in turn, dictated by such factors as the material properties of the object/product and ambient conditions. Where the object is a magazine, for example, the material properties may include the magazine's size and thickness as well as the type of the paper, coating and ink used on each sheet. When considered in detail even objects that are, for many purposes, considered identical/fungible, may have differences that slightly affect the satiation charging current.

One aspect of the present invention is directed to methods of electrostatically charging plural products that form a discontinuous product train of at least substantially similar products moving through at least one charge applying device which applies a charging current to the product train in response to the application of an ionizing voltage. The methods may include a step for determining a satiation charging current flowing from the charge applying device to at least one of the products of the discontinuous product train wherein the satiation charging current is that amount of charging current that will deposit substantially maximum charge on the surfaces of at least one product in the time it takes the product to move through the at least one charging device. The methods may also include a step for applying a substantially constant charging current to the discontinuous product train as the product train passes the at least one charge applying device wherein the charging current is substantially equal to the satiation charging current.

Another aspect of the present invention is directed to apparatus for electrostatically charging products that form a discontinuous product train of at least substantially similar products. Apparatus embodiments may include a means for charging at least one of the products at an ionizing voltage and a means for determining a satiation charging current of at least one of the products of the discontinuous product train wherein the satiation charging current is that amount of charging current that will deposit substantially maximum charge on the surfaces of at least one product in the time it takes the product to move through the at least one charging device. Such embodiments may also include a means for applying a charging current, that is at least substantially equal to the satiation charging current, to the product train as the product train passes the means for charging.

Still another aspect of the invention is directed to methods of electrostatically tacking plural continuous webs of material moving at substantially the same rate through at least one charge applying device which supplies a charging current in response to application of an ionizing voltage. Such methods may include steps for placing a first web against one or more additional webs to thereby form a layered continuous web; for determining a satiation charging current of the layered continuous web, wherein the satiation charging current is that amount of charging current that will deposit substantially maximum charge on the surfaces of an area of the layered web in the time it takes the area to move through the at least one charging device; and for applying a substantially constant charging current to the layered web to thereby tack the first continuous web to the one or more additional continuous webs, wherein the charging current is at least substantially equal to satiation current.

Yet another form of the invention may be directed to an apparatus for electrostatically tacking together adjacent layers of material that form a continuous web. This apparatus may include at least one charge applying device which supplies a charging current in response to the application of an ionizing voltage; a means for determining a satiation charging current of the layered continuous web, wherein the satiation current is that amount of charging current that will deposit substantially maximum charge on the surfaces of an area of the layered web in the time it takes the area to move through the at least one charging device; and a means for applying a substantially constant charging current to the layered web as the web passes the at least one charge applying device to thereby tack together adjacent layers of continuous web, the charging current being at least substantially equal to the satiation current.

Naturally, the above-described methods of the invention are particularly well adapted for use with the above-described apparatus of the invention. Similarly, the apparatus of the invention are well suited to perform the inventive methods described above.

Numerous other advantages and features of the present invention will become apparent to those of ordinary skill in the art from the following detailed description of the preferred embodiments, from the claims and from the accompanying drawings.

BRIEF DESCRIPTION OF THE DRAWINGS

The preferred embodiments of the present invention will be described below with reference to the accompanying drawings where like numerals represent like steps and/or structures and wherein.

DETAILED DESCRIPTION OF THE PREFERRED EMBODIMENTS

Figure 1:
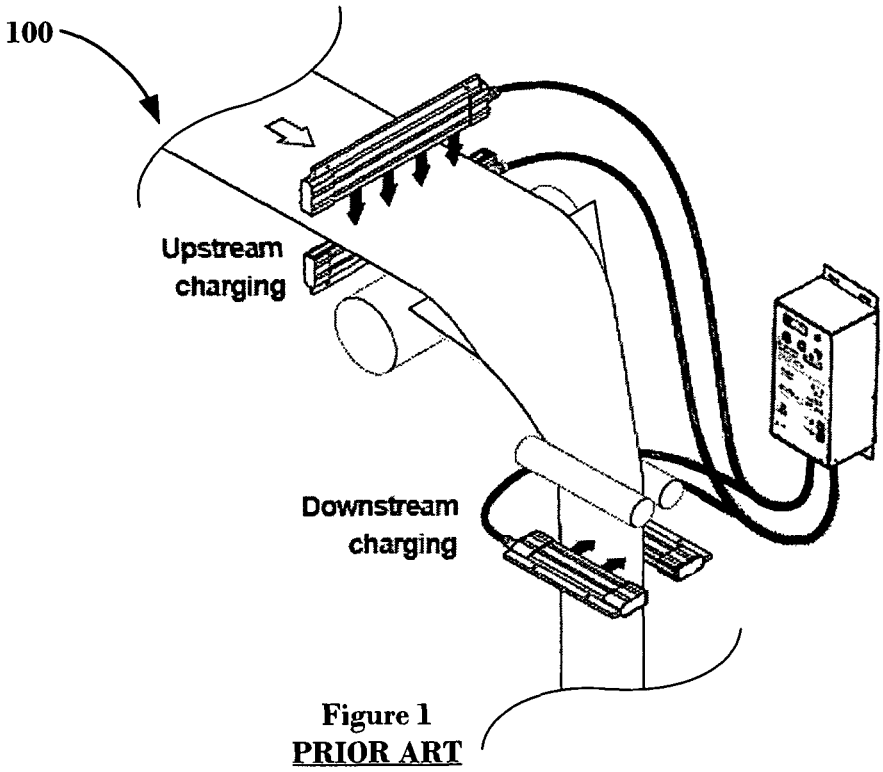
Figure 1 PRIOR ART
FIGS. 1 and 2 illustrate conventional electrostatic ribbon and stack tacking techniques and apparatus.
Figure 2:
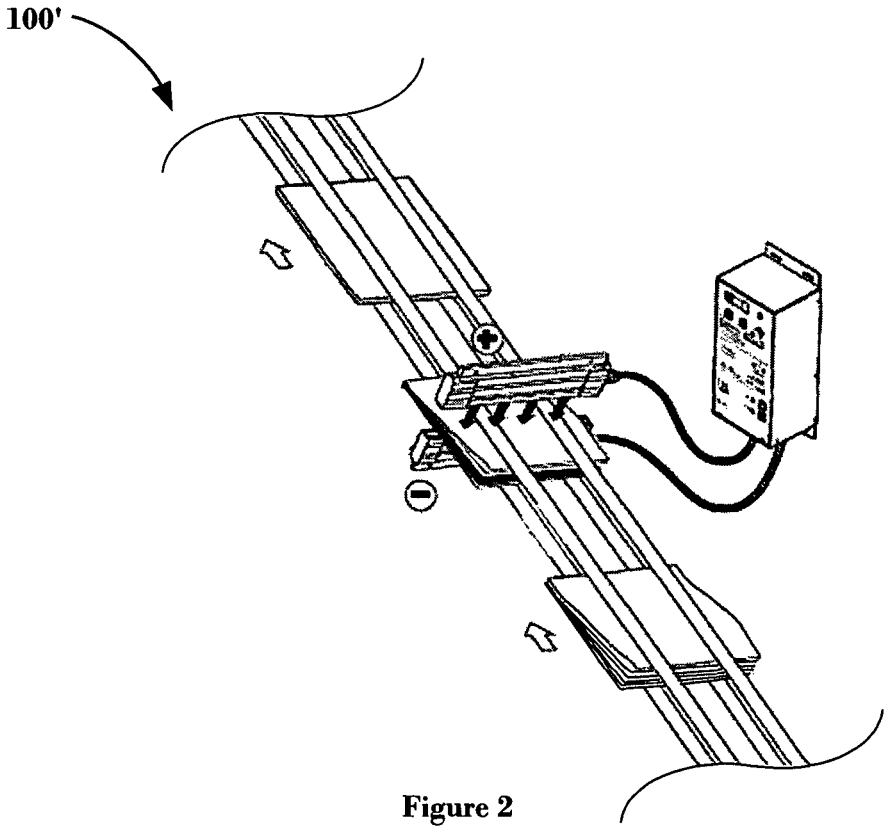
Figure 2 PRIOR ART
Figure 3:
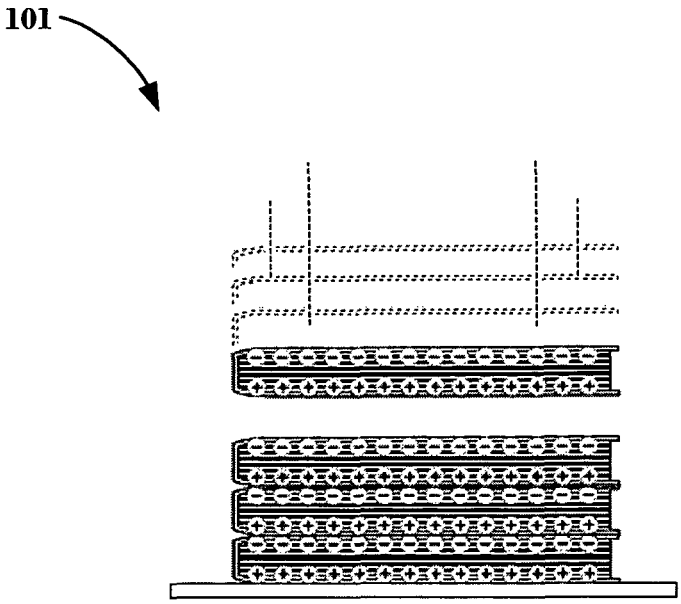
Figure 3 PRIOR ART
FIG. 3 illustrates surface charges in a stack of charged objects during stacking in a conventional stacking system.
Figure 4:
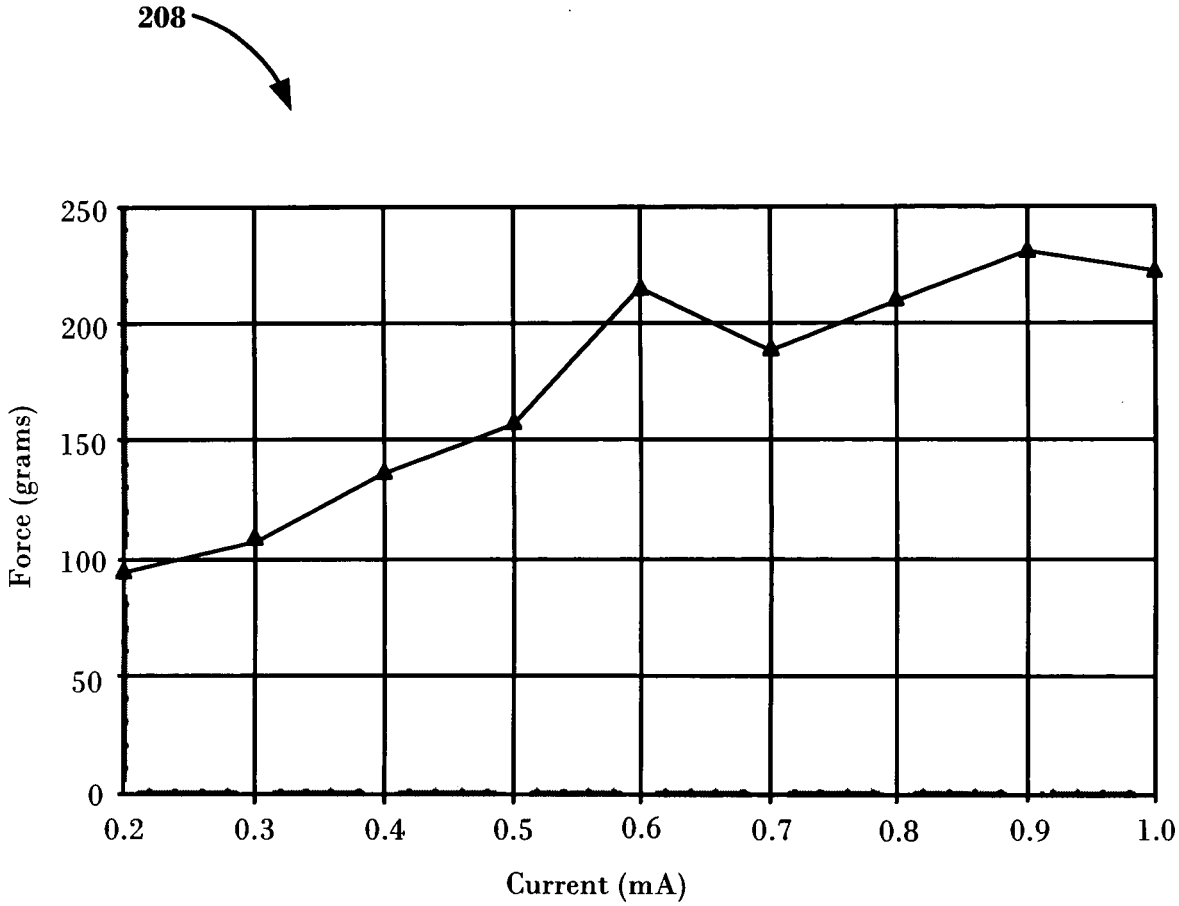
FIG. 4 is a chart showing the empirically determined relationship between static frictional force of the top object in a stack and the charging current absorbed by objects in that stack.
Figure 5:
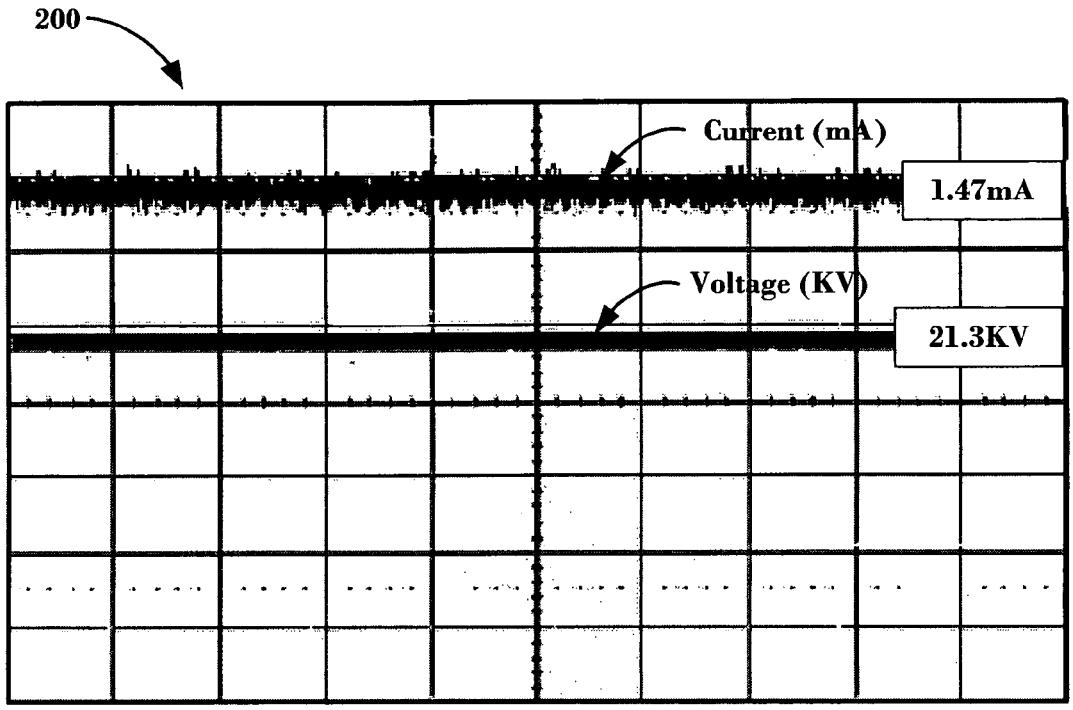
FIGS. 5-7 are oscilloscope screenshots which illustrate one method for determining the satiation charging current of a single object to a first order approximation and for satiation charging of another substantially similar object.
Figure 6:
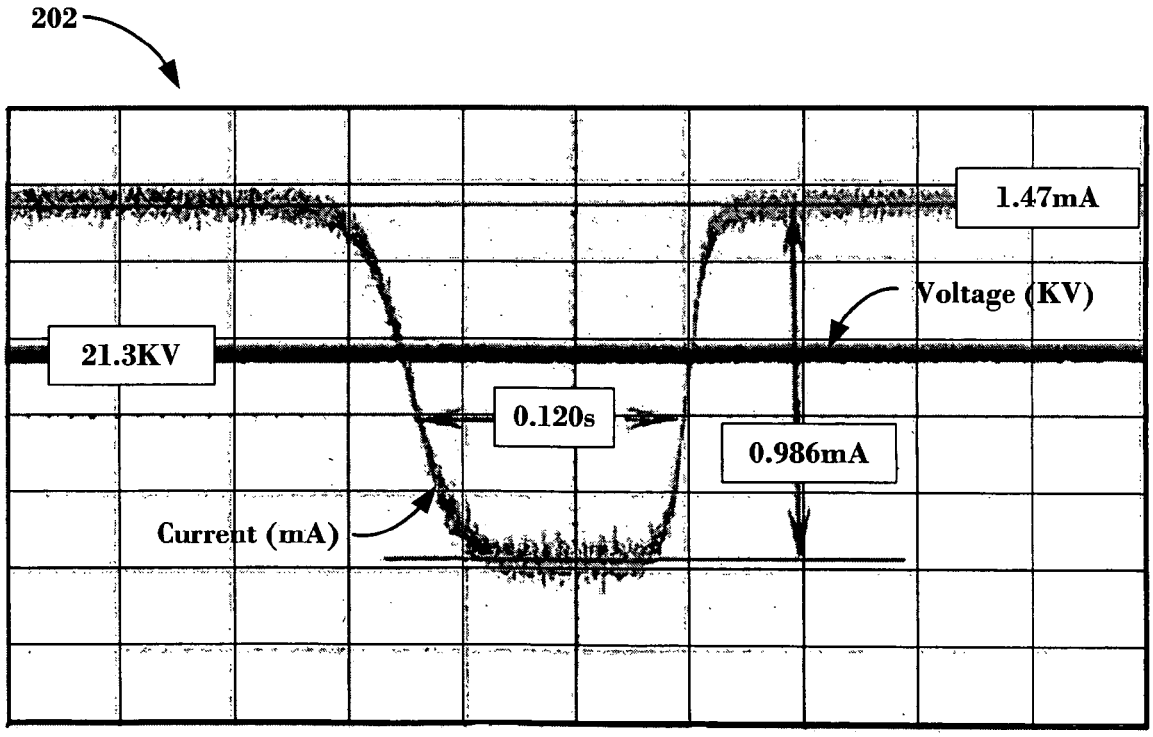
Figure 7:
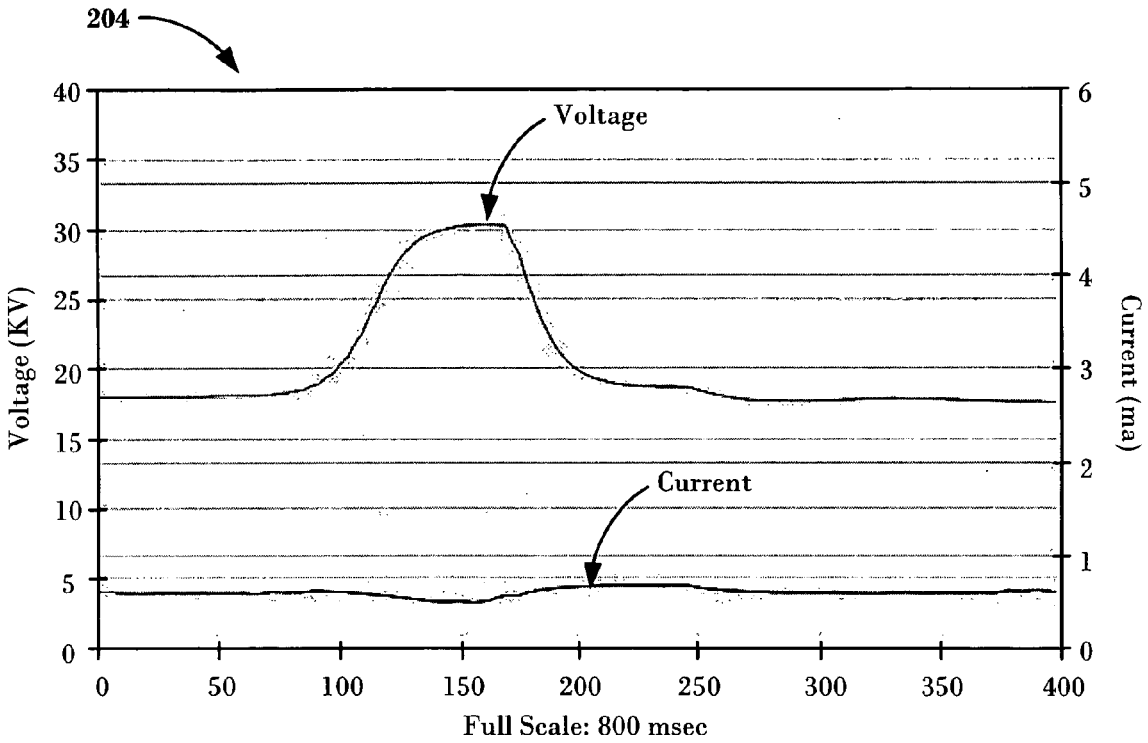

The oscilloscope screenshots of FIGS. 5-7 illustrate the basic concept of determining the satiation charging current of a single object and of effective charging of a substantially similar object in accordance with the invention. In particular, FIG. 5 is a screenshot 200 showing the current and voltage traces for unobstructed the charging bars. As shown in FIG. 5, the current and voltage traces are essentially constant. The current between the bars is 1.47 milliamps and the operating voltage is 21.3 kV.

To determine the satiation charging current of a single object to a first order approximation, a voltage setpoint (i.e., a selectable and substantially constant voltage level) of the charging bar power supply (generator) is established and the charging current is allowed to fluctuate in response to impedance changes between the bars. Restated, the power supply is operated in a constant voltage mode of operation. Provided the voltage setpoint is sufficiently high (well above the ionizing threshold for a given spacing between the bars) and that the charging generator(s) operate within normal operating limits, passing an object, such as a magazine or a catalog, between the bars will cause the charging current to drop to the satiation charging current. The oscilloscope screenshot 202 of FIG. 6 shows current and voltage traces before, during and after a single object passes between the bars. As shown therein, the voltage applied to the charging bars remained constant at the setpoints of +21.3 kV and −21.3 kV, respectively. However, as the object passed between the bars, the charging current dropped to about one third of that flowing between the unobstructed bars. In particular, when unobstructed, the charging current between the bars was 1.47 milliamps and passing a magazine between the bars dropped the current to about 0.5 milliamps. This latter value represents the satiation charging current of the object to a first order approximation.

Having, thus, determined the satiation charging current when an object is moving between the bars, this value can be used as a current setpoint (i.e., a selectable and substantially constant current limit) for a charging bar power supply when no object is present between the bars. In this way, the high voltage power supply will substantially continuously maintain the constant charging current at the satiation charging current and the operating voltage will be allowed to fluctuate in response to impedance changes between the bars, within the normal operating limits of the charging generator(s) up to their maximum output.

The oscilloscope screenshot 204 of FIG. 7 shows current and voltage traces before, during and after a single object passed between the bars for the current setpoint of 0.5 mA. As shown, the charging current remained constant at the setpoint of 0.5 mA before, during and after the magazine passed through between the bars. As for the operating voltage, when no object was present between the bars, the voltage dropped to about 18 kV (the minimum voltage required to necessary to maintain the 0.5 mA current). When an object is passing between the bars, the voltage increased to the maximum value of about 31.5 kV (for both polarities) so that the charging bars could continue to deliver 0.5 milliamps of charging current to the object.

Figure 8:
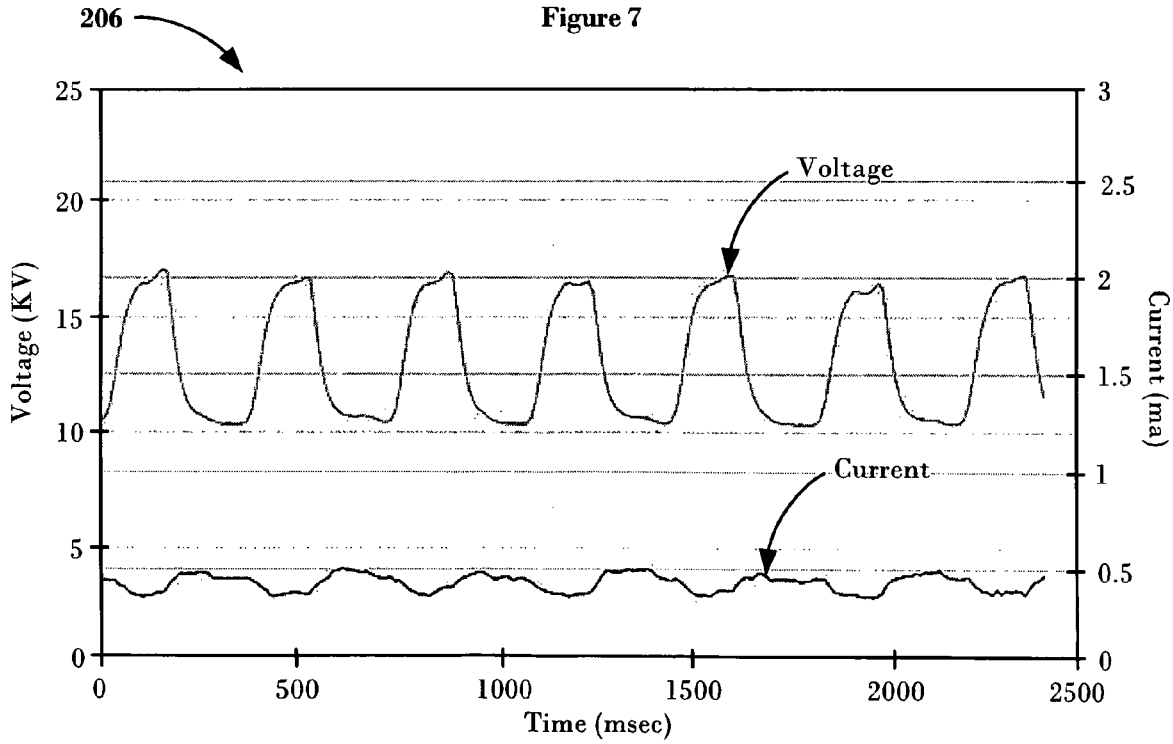
FIG. 8 is an oscilloscope screenshot showing current and voltage traces as a object train passes between a pair of charging bars in a preferred charging system.

The oscilloscope screenshot 206 of FIG. 8 shows current and voltage traces for similar processes applied to a train of discontinuous material passing between two charging bars. When the processes described above (for a current setpoint of 0.5 mA) are repeated for a discontinuous train of objects, the charging current and operating voltage appear as shown in FIG. 8. In particular, the voltage fluctuations up to a maximum voltage setpoint repeat, with the voltage rising as objects passed the gap and falling between consecutive objects. By contrast, the charging current exhibits only minor fluctuations around the setpoint (the satiation charging current). It will be appreciated that the power supply used to produce the screenshot of FIG. 8 could alternate between a constant current mode (CCM) (when no object is present between the bars) and a constant voltage mode (CVM) (when an object is between the bars). In the CVM, the voltage setpoint limits the voltage to a maximum level that is high enough to source the desired current for anticipated applications. In the CCM, the current setpoint limits the current to a maximum level and the invention offers substantial benefits over the prior art by judiciously selecting and applying this level. In this way, the charging current applied to a product train may remain substantially constant as the products and gaps pass the charge applying device(s).

Such systems and processes may maintain stable and strong pinning power during a given production run while saving energy and lengthening the life of the charging bars by lowering the voltage when there is open space between bars. Further, such systems and processes may automatically or on-demand adjust the operating voltage over time to compensate for changes in the line speeds, ambient conditions or paper dust buildup on the ionizing electrodes of the charging bars.

Charging bars used with the invention are preferably perpendicular to the product flow. In light of the discussion herein, those of ordinary skill will also appreciate that the effective length of charging bars used in conjunction with the invention are preferably shorter than or equal to the dimension of the object perpendicular to the direction of object flow.

While the processes described above illustrate the basic principles of the invention, they are idealized. As such they can be improved upon to perform under real world conditions. As shown in FIGS. 9 through 13, an improved process for identifying the satiation charging current with greater accuracy in discontinuous-material applications may include two steps; satiation charging current approximation, and ripple current adjustment.

Preferred Satiation Charging Current Approximation

Figure 9:
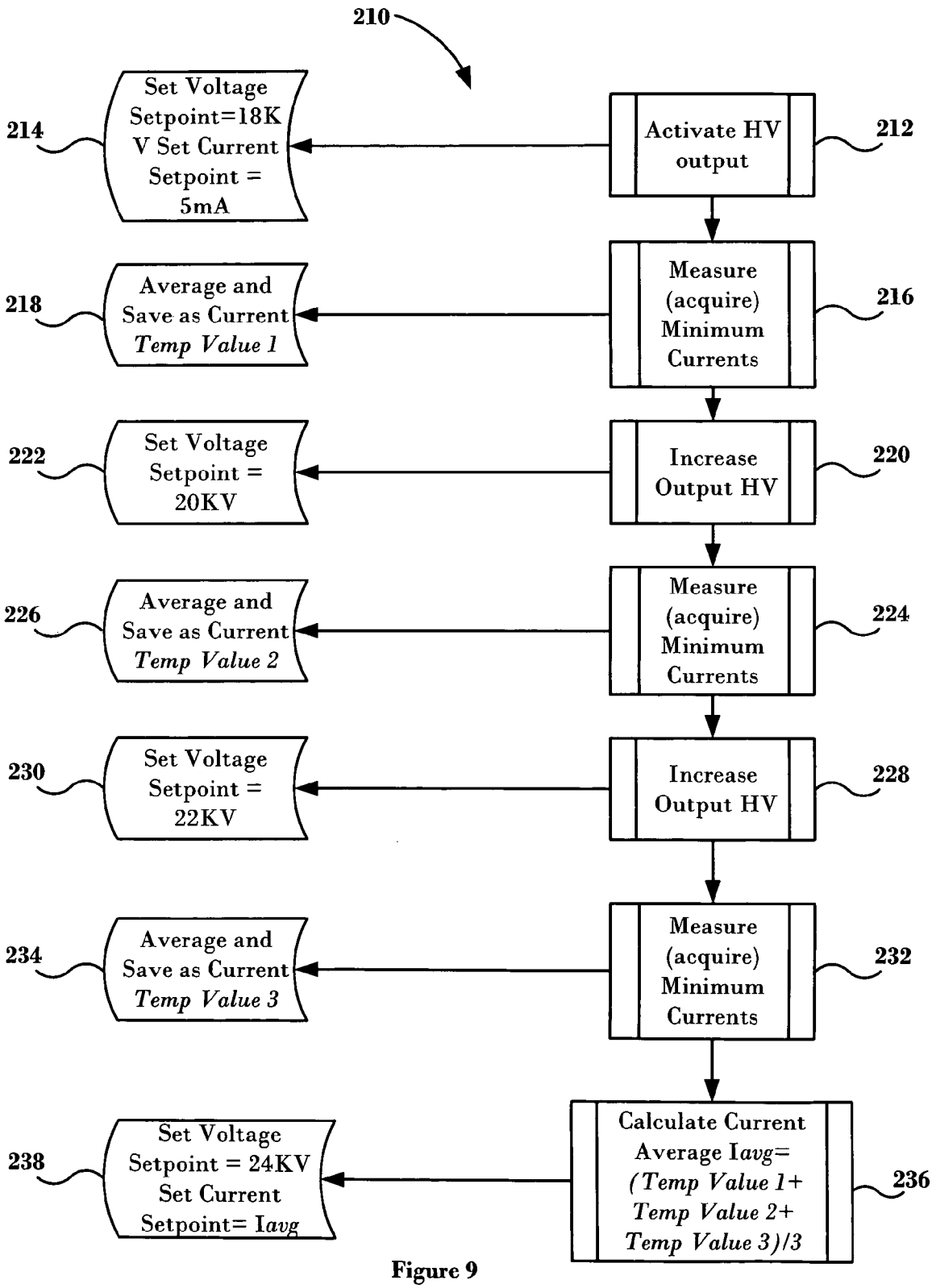
FIG. 9 is a flowchart of a preferred method of learning the satiation charging current to a first order approximation for a given discontinuous-material production run.
Figure 10:
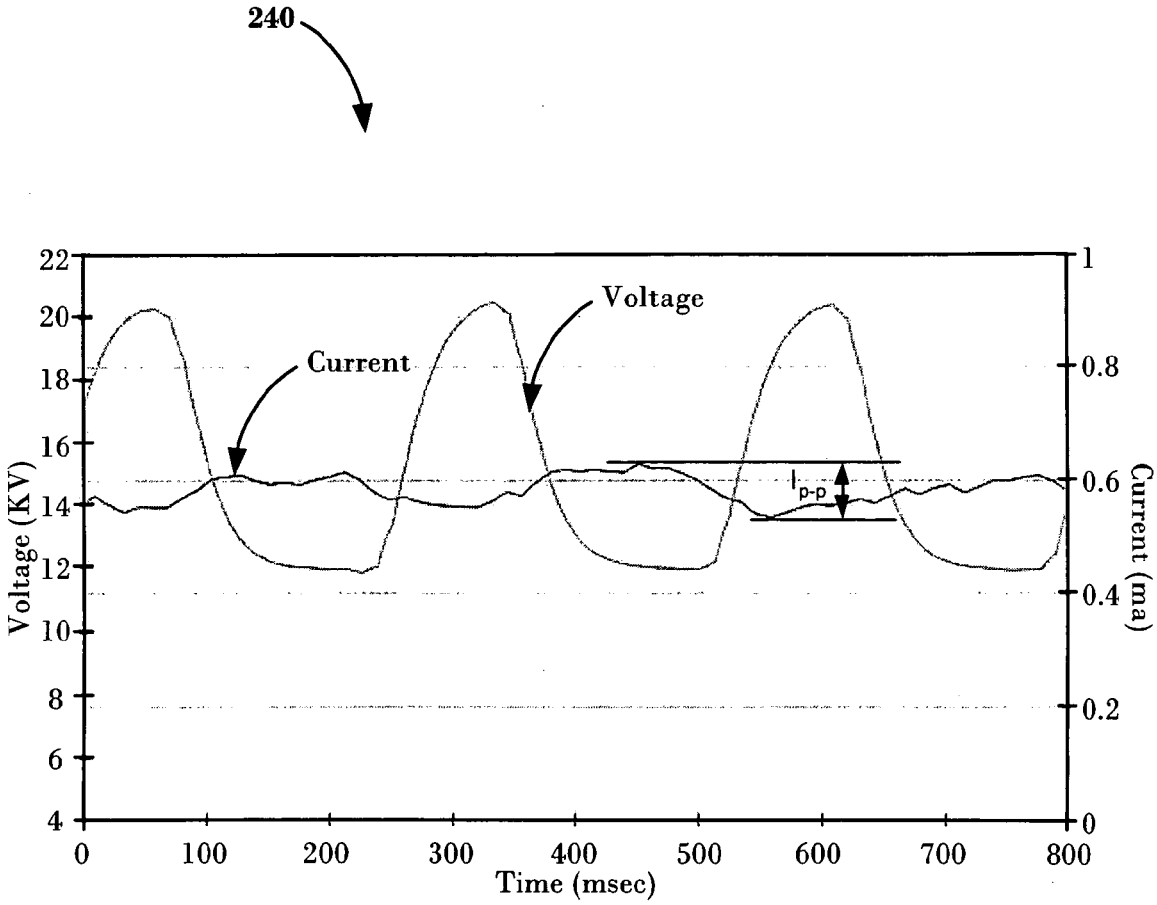
FIG. 10 is an oscilloscope screenshot showing a voltage trace and a first order approximation of a satiation charging current with a ripple component introduced thereto for a discontinuous-material production run in a preferred charging system.

The preferred satiation charging current approximation method identifies the charging current flowing between two charging bars when an object (such as a magazine, newspaper, book, fliers, and/or other printed matter) passes between the charging bars with greater accuracy than the method noted above. A flowchart 210 of the preferred Current Algorithm (SCA) is shown in FIG. 9. The process 210 begins when the high voltage power supply is activated 212 and proceeds to establish 214 a voltage setpoint (for the CVM) at a relatively low level (preferably at about 18 kV) and a current setpoint (for the CCM) at a level well above any reasonably anticipated use level (preferably at about 5 mA). As product flows between the charging bars, the instantaneous current may be measured 216 at 5 ms intervals and the minimum values of 5 cycles may be stored. The SCA then averages 218 minimum current values in accordance with eq1 and saves the results as the Current Temp Value 1=$I_{avg18KV}$ $$I_{ave18KV} = \frac{\sum_n I_{min}}{n} \quad \text{(eq 1)}$$

The voltage setpoint is then increased 220 and to 20 kV and the above process is repeated for a number of cycles saving 224 and 226 the average minimum current values as Current Temp Value 2=$I_{avg20KV}$. The generator voltage is again increased 228 and the setpoint is set 230 to 22 kV for a number of cycles and the average minimum current is saved 232 and 234 as Current Temp Value 3=$I_{avg22KV}$.

These minimum values may then be averaged 236 in accordance with eq2 as $$I_{avg} = \frac{(I_{avg18KV} + I_{avg20KV} + I_{avg22KV})}{3} \quad \text{(eq 2)}$$

The generator current output setpoint may then be set 238 to the average found in eq2 ($I_{avg}$) (representing the calculated satiation charging current for this particular production run moving at this particular velocity) at block 238 and the generator's maximum voltage output may be set 238 to a predetermined value higher than the last voltage setpoint (for example, 24 kV or higher).

Preferred Ripple Current Adjustment

With an approximation of the satiation charging current achieved with the process of FIG. 9, further refinement may be attained with the preferred ripple current adjustment algorithm of FIGS. 10 through 13. The ripple current process either verifies the accuracy of the satiation charging current approximation determined per FIG. 9 above or adjusts the satiation charging current with an iterative process until a final satiation charging current has been determined. In the screenshot 240 of FIG. 10, a ripple current trace is shown in conjunction with a voltage trace for several cycles as a product train passes between two charging bars. As shown the ripple current Ip-p is defined as the difference between current local maxima (occurring during a CCM) and a local minima (occurring during an adjacent CVM with the voltage setpoint at 20 kV). The ripple current algorithm described herein has been used to iteratively and incrementally vary the charging current away from satiation charging current approximation within a predetermined range. By monitoring the effect of such incremental changes, the ripple current algorithm will result in a final value for the satiation charging current (either the first order approximation or some newly derived value). That final value can then be used as the current setpoint for a given production run (the run mode) of like objects/products/material.

Figure 11:
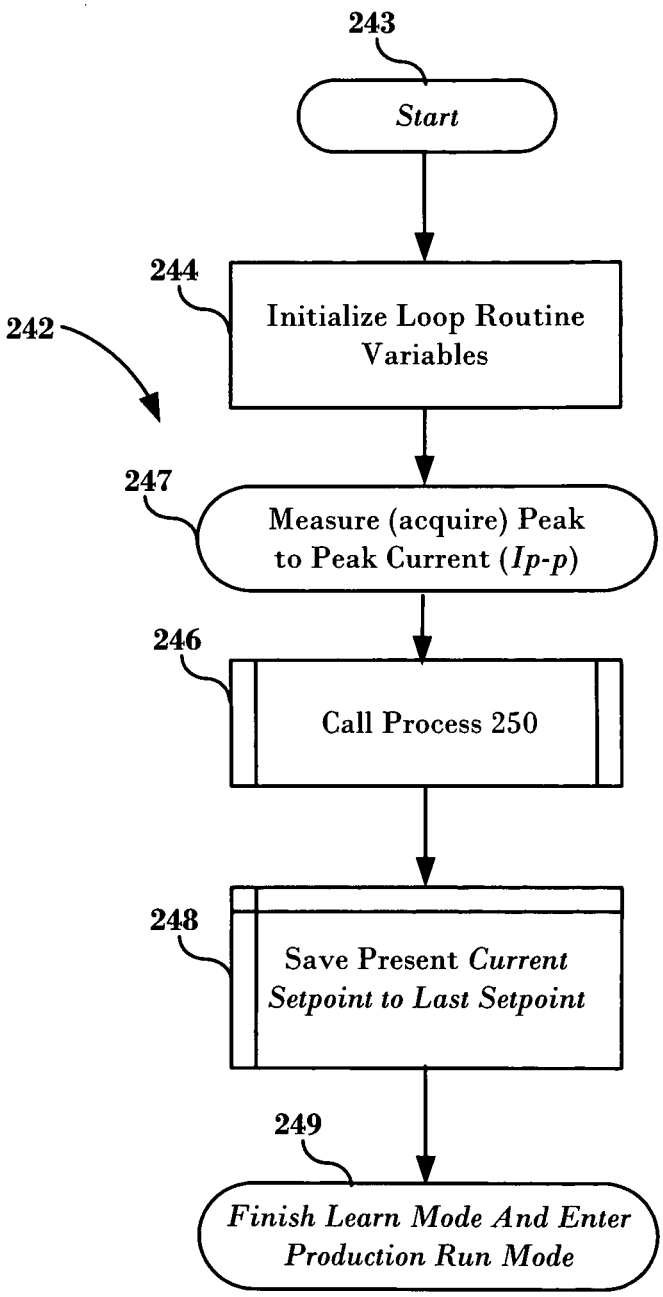
FIG. 11 is a flowchart of a preferred method of learning a final satiation charging current for a given discontinuous-material production run.

FIG. 11 shows the flowchart 242 of a preferred process for applying a peak-to-peak ($I_{P\text{-}P}$) current deviation (the magnitude of the ripple current) to the previously learned satiation charging current first order approximation. Process 242 begins by initializing 244 various loop routine variables such as the predetermined voltage and satiation charging current setpoints, and various increment and decrement parameters for the current setpoint (DLoop, ULoop, and dX %). Initializing 244 may also include setting the last current setpoint equal to the predetermined current setpoint. Then the product train passes between the two bars and the instantaneous charging current is measured 246 at 5 ms intervals and processed to record the local maxima and minima. These values are collected over several cycles and averaged 246 (to reduce the effects of any possible anomalous readings) in accordance with eq3 below:

$$I_{p-p} = \frac{\sum_n I_{max} - \sum_n I_{min}}{n} \quad \text{(eq 3)}$$

and preset current ($I_{P-P}$) is saved 248 to temporary memory.

Figure 12:
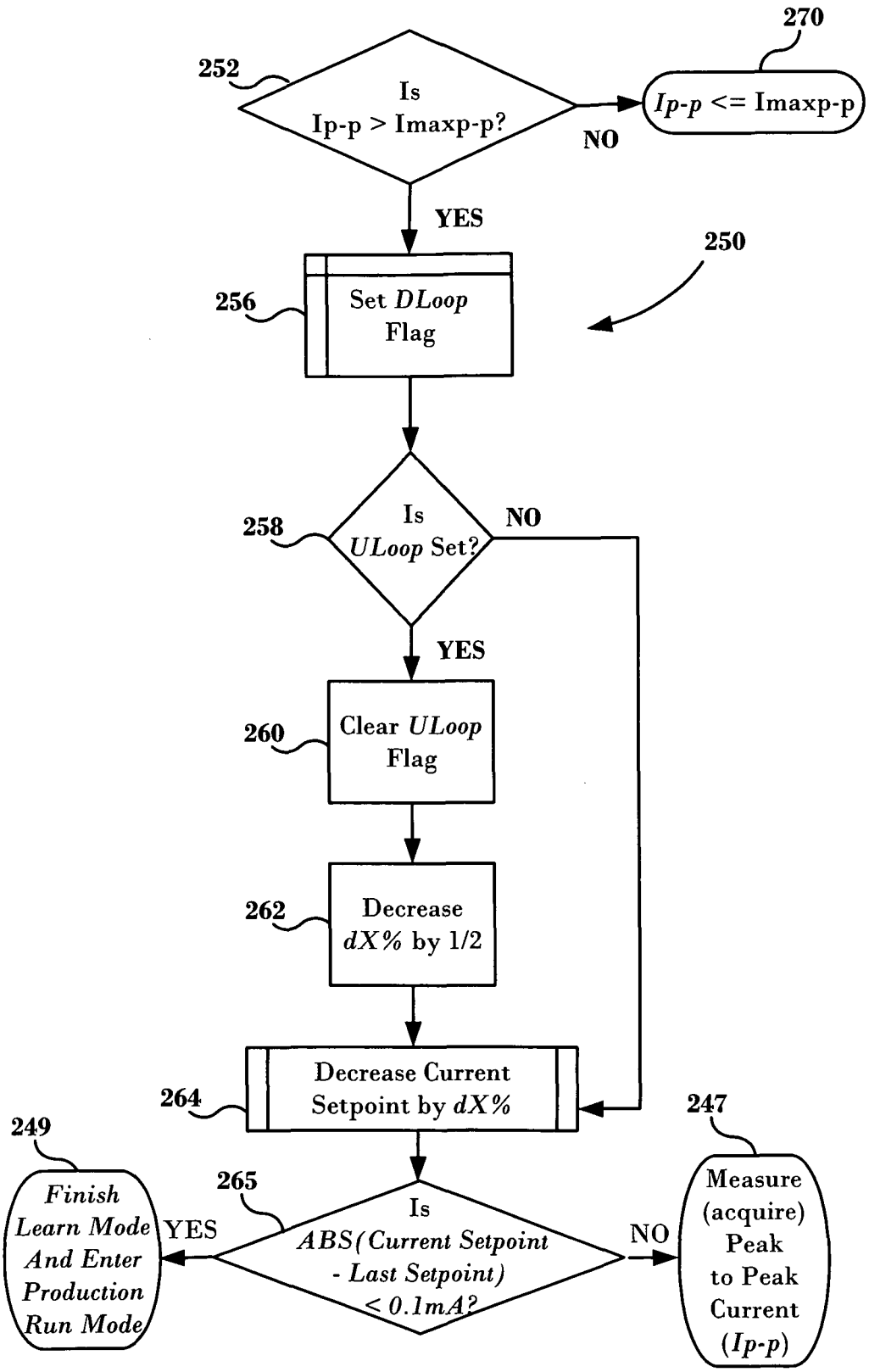
FIG. 12 is a flowchart of a first subroutine for introducing a ripple component to an approximate satiation charging current for a given discontinuous-material production run.
Figure 13:
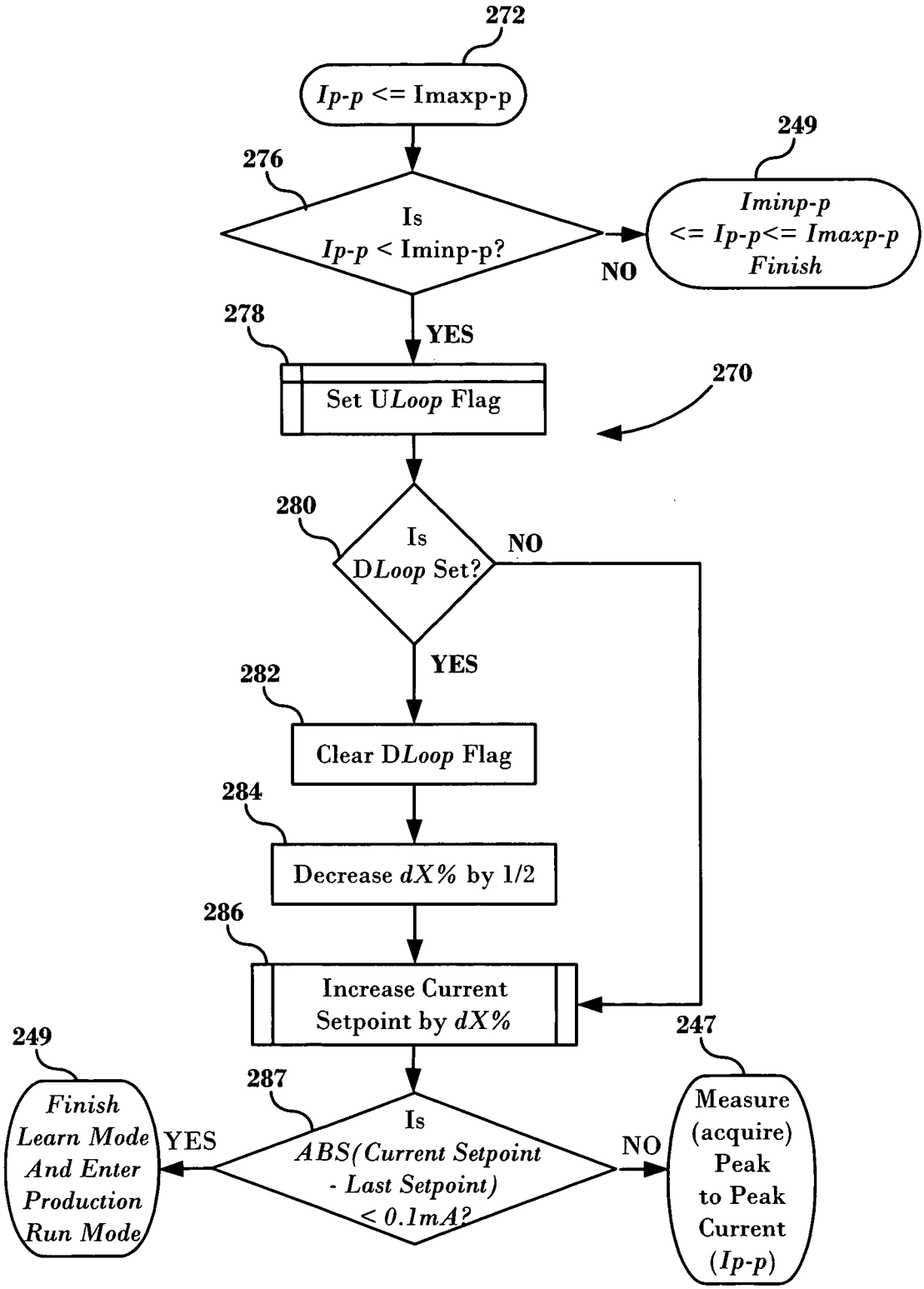
FIG. 13 is a flowchart of a second subroutine for introducing a ripple current to an approximate satiation charging current for a given discontinuous-material production run.

With added reference now to FIG. 12, process 250 is called in 246 of FIG. 11 and begins with a comparison 252 between $I_{P-P}$ and ripple maximum value ($I_{maxP_P}$). If $I_{P-P}$ is found to be less than or equal to $I_{maxP_P}$ (preferably equal to about 0.20 mA), $I_{P-P}$ is processed in accordance with process 272 of FIG. 13.

If $I_{P-P}$ is determined 252 to be greater than $I_{maxP-P}$, process 250 sets 256 the DLoop flag, indicating that a decrease in current setpoint was the last change in the current setpoint. Decision 258 determines the state of the ULoop flag (indicating that an increase in the current setpoint was the previous change to the current setpoint). If ULoop is set, the ULoop flag is cleared 260 and the dX % (preferably equal to about 10%) is decreased 262 by half (½ or, preferably, 5%. A new current setpoint is then calculated 264 in accordance with eq 4 below. If it is determined 258 that ULoop is not set, a different current setpoint is calculated 264 in accordance with eq 4 below.

$$\text{CurrentSetpoint}=\text{CurrentSetpoint}-(\text{CurrentSetpoint})(dX\%) \quad \text{(eq 4)}$$

To prevent an endless loop condition, the change in the current setpoint is tested 265. If the absolute value of the change in the current setpoint is less than 0.1 mA, the ripple current adjustment routine ends 249 and the power supply enters a run mode, during which the charging bar power supply is operated in a conventional manner using the final satiation charging current and voltage setpoints as control parameters. Otherwise, the process passes back to the flow of FIG. 11 where another ripple current adjustment cycle begins by measuring 247 the current ripple anew. As noted above, $I_{P-P}$ is processed in accordance with process 272 of FIG. 13 if $I_{P-P}$ is determined 252 to be less than or equal to $I_{maxP_P}$. In process 272 $I_{P-P}$ is compared 276 with ripple minimum value ($I_{minP_P}$). If $I_{P-P}$ is determined 276 to be greater than $I_{minP_P}$ (preferably equal to about 0.05 mA), then $I_{P-P}$ is within the range ($I_{minP_P}<=I_{P-P}<=I_{maxP_P}$), the ripple current adjustment routine ends 249 and the power supply enters a run mode, during which the charging bar power supply is operated in a conventional manner using the final satiation charging current and voltage setpoints as control parameters.

If $I_{P-P}$ is determined 276 to be less than $I_{minP_P}$, process 270 sets 278 the ULoop flag, indicating that an increase in current setpoint was the last change in the current setpoint. Decision checks 280 the state of DLoop flag (indicating that a decrease in the current setpoint was the previous change to the current setpoint). If DLoop flag is set 280, the DLoop flag is cleared 282 and the dX % is decreased 284 by half (½ or, preferably about 5%). A new current setpoint may then be calculated 286 in accordance with eq 5 below:

$$\text{CurrentSetpoint}=\text{CurrentSetpoint}+(\text{CurrentSetpoint})(dX\%) \quad \text{(eq 5).}$$

To prevent an endless loop condition the change in the current setpoint is tested 287. If the absolute value of the change in the current setpoint is less than 0.1 mA, the ripple current adjustment routine ends 249 and the power supply enters a run mode, during which the charging bar power supply is operated in a conventional manner using the final satiation charging current and voltage setpoints as control parameters. Otherwise, the process passes back to the flow of FIG. 11 where another ripple current adjustment cycle begins by measuring 247 the current ripple anew.

Those of ordinary skill will appreciate that setting 256 DLoop and 278 ULoop flags, controls the size of any adjustment made to the current setpoint. Thus, DLoop and ULoop flags will indicate if an adjustment to the current setpoint brings the setpoint beyond the $I_{minP_P}$ and $I_{maxP_P}$ bounds. When DLoop and ULoop flags are both set, the last current setpoint adjustment was too large and dX % should be decreased 264, 286.

Figure 14:
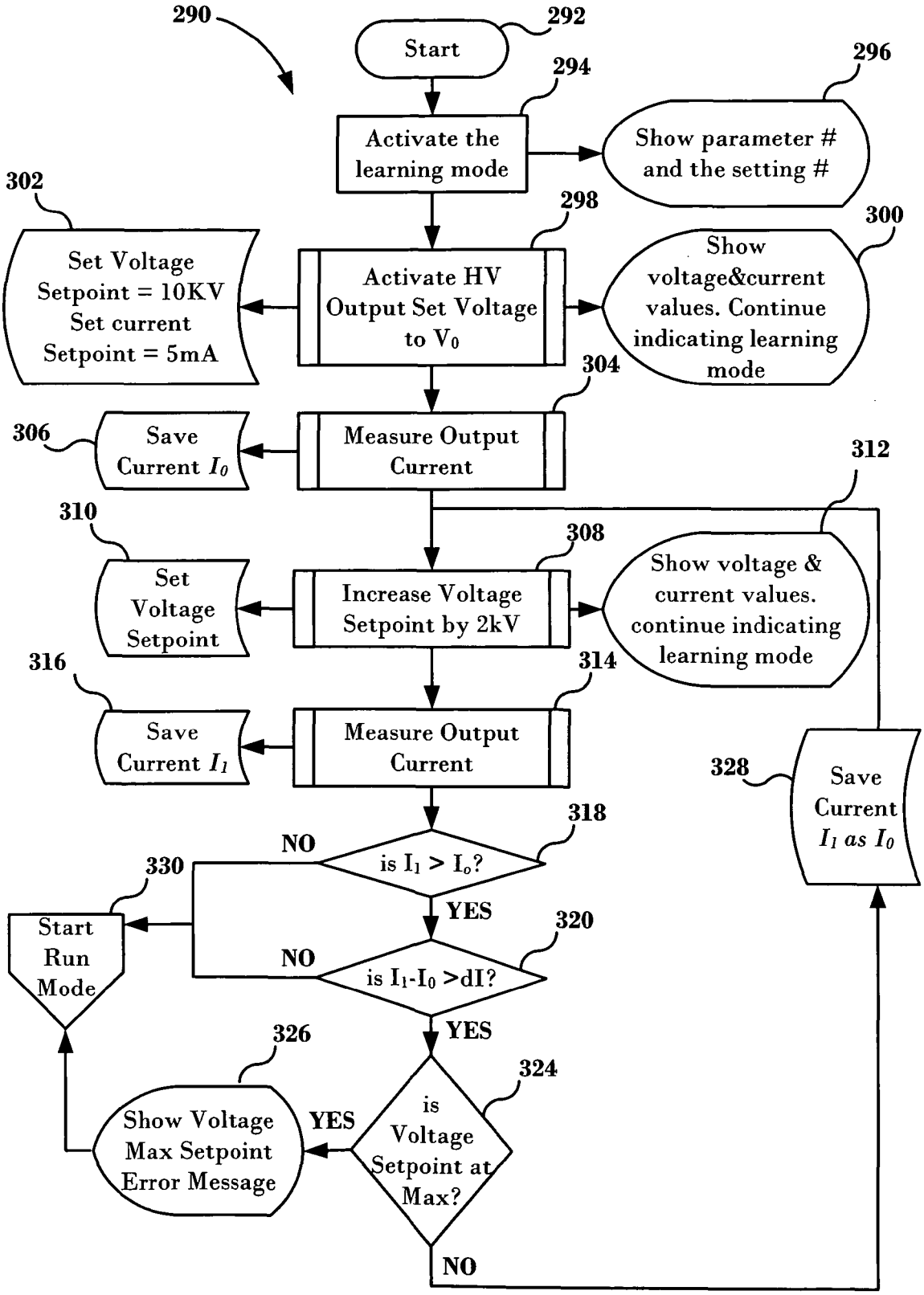
FIG. 14 is a flowchart of a preferred method of learning a final satiation charging current for a given continuous-ribbon production run.

Those of ordinary skill will appreciate that the above described methods and apparatus primarily apply to satiation charging of discontinuous product trains. In the event the material flow is continuous (such as with continuous webs) final satiation charging current value for a given production run is learned according to flowchart 290 shown in FIG. 14 and then applied in the run mode shown in FIG. 15. As shown in FIG. 14, process 290 begins by activating 294 a learn mode and displays 296 the satiation charging current approximation and voltage setpoint to the user. The generator's output is activated 298 and setpoints are set 302 to initial starting values of about 18 kV and about 5 mA (respectively). These values may then be displayed 300 for viewing. Process 290 may then begin to measure 304 the output current and to save 306 this value in temporary memory as $I_0$. The generator's output voltage may then be increased 308 by 2 kV and the newly increased voltage set 310 as the voltage setpoint. The output current may then be measured 314 and that value saved 316 in temporary memory as $I_1$. The display may be updated to show 312 the newly updated values and that the apparatus is still in the learning mode.

The two measured and saved currents $I_0$ and $I_1$ may be compared 318. If $I_1$ is smaller than $I_0$, the current has decreased with increased voltage. This indicates that the current has reached satiation charging, process 290 terminates 330 and the run mode (330 of FIG. 15) is initiated with $I_0$. Otherwise, the current has increased (indicating that the current has not reached satiation charging) and process 290 may continue to determine 320 whether $I_1$ and $I_0$ differ by a predetermined amount (dI). If $I_1-I_0$ is determined 320 to be less than dI (preferably equal to about 0.05 mA), then the current has reached or is within a small increment of satiation charging and, therefore, process 290 ends and the start run mode (330 of FIG. 15) is initiated.

Continuing with process 290, if $I_1-I_0$ is determined 320 to be greater than dI and the voltage setpoint is determined 324 to be at its maximum setpoint, the current has reached the satiation value and, therefore, process 290 ends and the start run mode (330 of FIG. 15) is initiated with $I_1$. If $I_1-I_0$ is determined 320 to be greater than dI and the voltage setpoint is determined 324 to not be at the maximum setpoint, then $I_1$ is saved 328 as $I_0$ and the process returns to 308 and steps 310,314,316,318,320,324, 328 are repeated until the satiation value is reached or is within a small increment. Otherwise, an error message is displayed and the run mode 330 is initiated.

Figure 15:
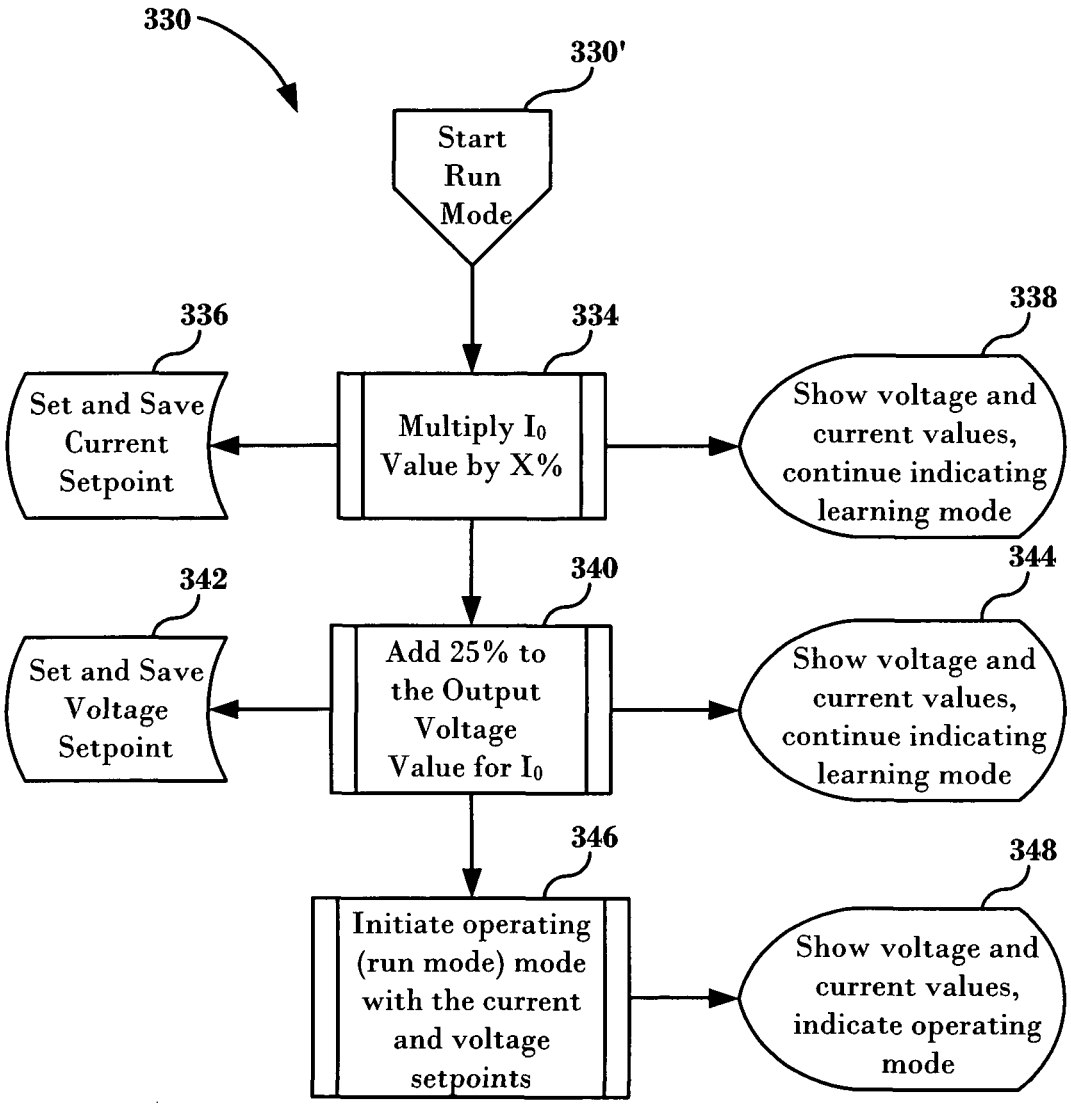
FIG. 15 is a flowchart of a preferred method of charging a given continuous-ribbon production run using the final satiation charging current learned using the method of FIG. 14.

Referring to the continuous-material run mode 330 of FIG. 15, the last value of the learned satiation charging current ($I_0$) in the previous process 290 is increased 334 by a predetermined increment X % ((preferably equal to about 10%), applied 336 to the power supply as the current setpoint and the new current setpoint is displayed 338 for viewing. This predetermined increment is preferably increased to be sure that the $I_0$ is at or slightly above the actual satiation current level. The voltage setpoint is adjusted 340 to 25% higher than the last voltage value for $I_0$ (found in the above process 290), applied 342 to the power supply and the new voltage setpoint is displayed 344 for viewing. This voltage setpoint is preferably increased to ensure operation in the constant current mode with no products being charged (between products in a discontinuous product train. The routine is completed by setting the power supply to run mode 346 and by displaying 348 a run mode indicator and the final voltage and current values.

Figure 16:
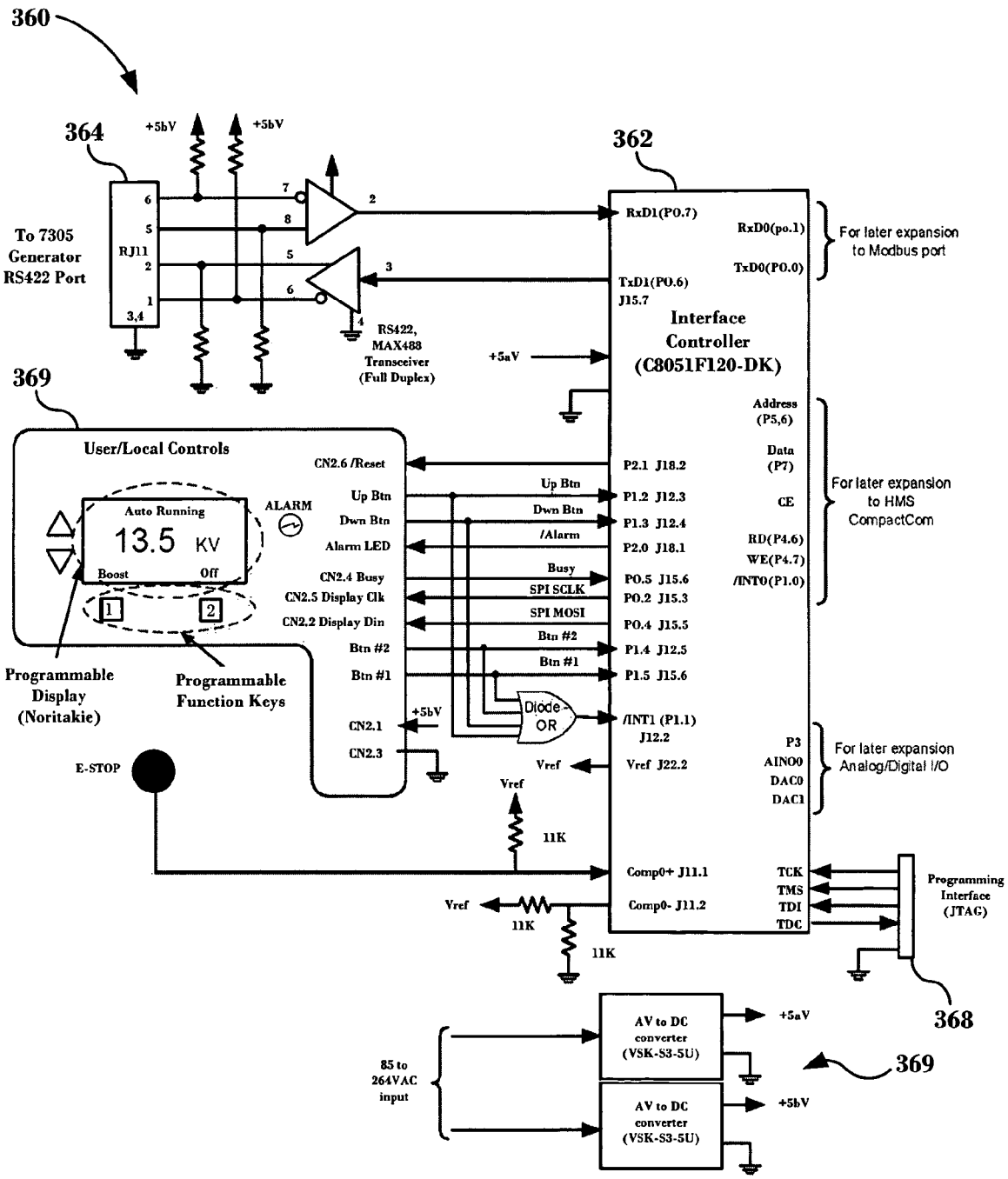
FIG. 16 is a schematic representation of a first preferred apparatus for use with preferred method embodiments of the invention.

FIG. 16 shows a first preferred apparatus embodiment 360 of the invention. This embodiment is intended for use with an off-the-shelf 7305 power supply and a pair of 7340 charging bars (not shown) both made by MKS, Ion Systems of 1750 North Loop Road, Alameda, Calif. 94502. The apparatus 360 may include a C8051F120 Interface Controller made by Silicon Laboratories Inc. having an office at 400 West Cesar Chavez, Austin, Tex. 78701 that may be communicatively linked to the 7305 power supply via communications port 364. As is known in the art, the C8051F120 controller 363 includes a microprocessor and sufficient peripherals to run software uploaded via interface 368. In preferred embodiments of the invention, that software embodies the methods and processes described throughout the specification. Thus, controller 363 loaded with the relevant instruction set/software provides the means for performing the various calculation, communication, storage, alarm, control and other functions described herein. As shown in FIG. 16, controller 362 may be communicatively linked to control systems, computer systems, networks and/or other infrastructure of an on-site installation by adding any one or more of a Modbus port, an HMS CompactCom port, and/or an analog/digital I/O as is known in the art. Controller 362 may also be communicatively linked to a display apparatus 366 that may include a display panel model # GU140X32F-7003 NORITAKE ITRON CORP 3-1-36, Noritake-shinmachi, Nishi-ku, Nagoya-shi, Aichi 451-8501 Japan, one or more alarm indicators and/or buttons and/or function keys as shown in FIG. 16. Low-voltage power supply 369 may supply the low voltage to power the various component shown in FIG. 16 as is known in the art. Although the inventive charging system may be compatible with external sensor(s) (such as voltage and/or current sensors), there are preferably no extra sensor(s) used to monitor the voltage and/or the current of the charging bars because the 7305 power supply and 7340 charging bars provide the necessary functionality.

Figure 17:
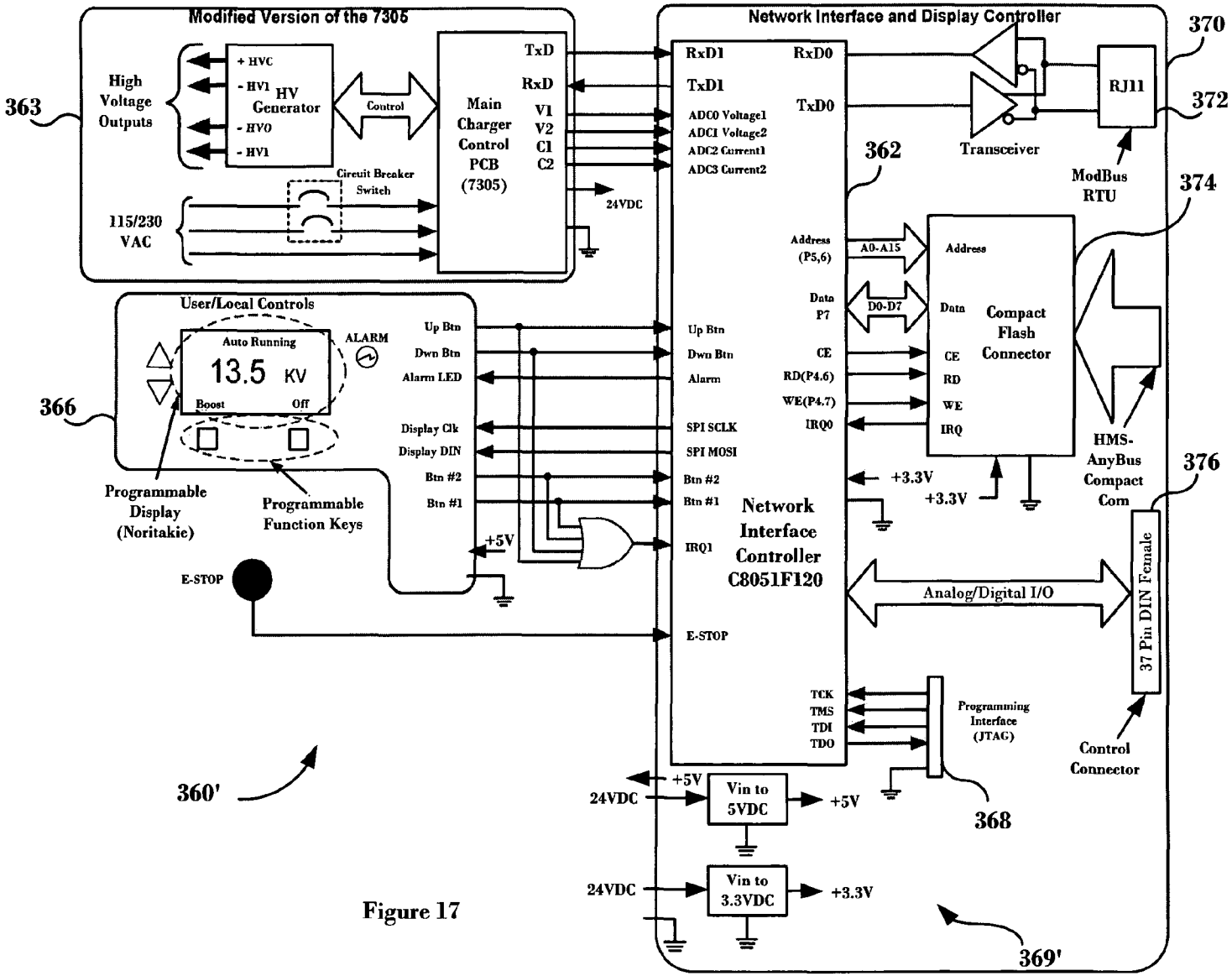
FIG. 17 is a schematic representation of a second preferred apparatus for use with preferred method embodiments of the invention.

FIG. 17 shows a second preferred apparatus embodiment 360' of the invention. As shown therein this embodiment is preferably similar to that of FIG. 16. One difference between this embodiment and that of FIG. 16 lies in the use of a modified version of the 7305 power supply 363. In particular, this embodiment is design for use with and may include a simplified version of the Ion Systems 7305 power supply 363 in which the HV generator and the Main Charger Control PCB remain essentially unchanged, but various features of a stock 7305 power supply have been removed to ensure that setpoints may be stored, parameters may be read and current and voltage may be monitored as quickly and as easily as possible. The embodiment of FIG. 17 may also incorporate the controller 362 into a include a Network Interface and Display Controller 370 which may include a Modbus RTU 372, an HMS-AnyBus CompactCom 376 and an analog/digital I/O 376 to communicatively link controller 370 to control systems, computer systems, networks and/or other infrastructure of an on-site installation.

As with the apparatus of FIG. 16, apparatus 360' may include a C8051F120 Interface Controller 362 made by Silicon Laboratories Inc. that may be communicatively linked to the high voltage (ionizing) power supply 363. As is known in the art, the C8051F120 controller 362 includes a microprocessor and sufficient peripherals to run software uploaded via interface 368. In preferred embodiments of the invention, that software embodies the methods and processes described throughout the specification. Thus, controller 362 loaded with the relevant instruction set/software provides the means for performing the various calculation, communication, storage, alarm, control and other functions described herein. As with the embodiment of FIG. 16, this embodiment may include a display panel model # GU140X32F-7003 NORITAKE ITRON CORP 3-1-36, Noritake-shinmachi, Nishi-ku, Nagoya-shi, Aichi 451-8501 Japan, one or more alarm indicators and/or buttons and/or function keys. A low-voltage power supply 369' may supply the low voltage to power the various component shown in FIG. 17 as is known in the art. Although the inventive charging system may be compatible with external sensor(s) (such as voltage and/or current sensors), there are preferably no extra sensor(s) used to monitor the voltage and/or the current of the charging bars because the high voltage power supply 363 and 7340 charging bars provide the necessary functionality.

While the present invention has been described in connection with what is presently considered to be the most practical and preferred embodiments, it is to be understood that the invention is not limited to the disclosed embodiments, but is intended to encompass the various modifications and equivalent arrangements included within the spirit and scope of the appended claims. With respect to the above description, for example, it is to be realized that the optimum dimensional relationships for the parts of the invention, including variations in size, materials, shape, form, function and manner of operation, assembly and use, are deemed readily apparent to one skilled in the art, and all equivalent relationships to those illustrated in the drawings and described in the specification are intended to be encompassed by the appended claims. Therefore, the foregoing is considered to be an illustrative, not exhaustive, description of the principles of the present invention.

Other than in the operating examples or where otherwise indicated, all numbers or expressions referring to quantities of ingredients, reaction conditions, etc. used in the specification and claims are to be understood as modified in all instances by the term "about." Accordingly, unless indicated to the contrary, the numerical parameters set forth in the following specification and attached claims are approximations that can vary depending upon the desired properties, which the present invention desires to obtain. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical values, however, inherently contain certain errors necessarily resulting from the standard deviation found in their respective testing measurements.

Also, it should be understood that any numerical range recited herein is intended to include all sub-ranges subsumed therein. For example, a range of "1 to 10" is intended to include all sub-ranges between and including the recited minimum value of 1 and the recited maximum value of 10; that is, having a minimum value equal to or greater than 1 and a maximum value of equal to or less than 10. Because the disclosed numerical ranges are continuous, they include every value between the minimum and maximum values. Unless expressly indicated otherwise, the various numerical ranges specified in this application are approximations.

What is claimed is:

1. A method of electrostatically charging plural products that form a discontinuous product train of substantially similar products moving through at least one charge applying device which applies a charging current to the product train in response to the application of an ionizing voltage, the method comprising:

determining a satiation charging current flowing from the charge applying device to at least one of the products of the discontinuous product train, the satiation current being that amount of charging current that will deposit substantially maximum charge on the surfaces of at least one product in the time it takes the product to move through the at least one charging device; and applying a substantially constant charging current to the discontinuous product train as the product train moves through the at least one charge applying device, the charging current being substantially equal to the satiation current.

2. The method of claim 1 wherein the step of determining a satiation current further comprises:

charging at least one of the products moving through the charge applying device at a first ionizing voltage;

measuring the charging current flowing from the charge applying device to the at least one product during the step of charging at a first voltage;

charging the at least one product moving through the charge applying device at a second ionizing voltage that exceeds the first voltage;

measuring the current flowing from the charge applying device to the at least one product during the step of charging at a second voltage; and determining that the second measured current is the satiation current if the first measured current is substantially equal to or greater than the second measured current.

3. The method of claim 1 wherein the step of determining a satiation current further comprises:

charging at least one of the products moving through the charge applying device at a first ionizing voltage;

measuring the current flowing from the charge applying device to the at least one product during the step of charging at a first voltage;

charging the at least one product moving through the charge applying device at a second ionizing voltage that exceeds the first voltage;

measuring the current flowing from the charge applying device to the at least one product during the step of charging at a second voltage; and determining that the second measured current is the satiation current if the absolute value of the difference between the first and second measured currents is less than or equal to a predetermined value.

4. The method of claim 1 wherein the step of determining a satiation current further comprises:

charging at least one of the products moving through the charge applying device at an ionizing voltage;

measuring the current flowing from the charge applying device to the at least one product during the step of charging;

increasing the voltage applied to the charge applying device during the step of charging at least until the charging current does not substantially increase; and determining that the value of the satiation current is the value of the measured current when the charging current does not substantially increase.

5. The method of claim 1 wherein each of the products comprises a plurality of sheets bound together;

the bound products form a discontinuous product train of at least substantially similar bound products moving through the charge applying device with a substantially constant velocity; and the step of determining comprises determining a satiation charging current for at least one of the bound products of the discontinuous product train, the satiation current being that amount of charging current that will deposit substantially maximum charge on the surfaces of at least one bound product in the time it takes the bound product to move through the at least one charging device.

6. The method of claim 5 wherein the step of determining further comprises determining a satiation current for multiple bound products of the discontinuous product train and calculating a satiation current that is a function of the satiation currents of the multiple bound products; and the step of applying comprises applying a substantially constant charging current to the discontinuous product train moves through the at least one charge applying device, the charging current being at least substantially equal to the calculated satiation current.

7. The method of claim 5 wherein the step of applying comprises substantially continuously applying a substantially constant charging current to the discontinuous product train as the product train moves through the charge applying device, the charging current being substantially equal to the satiation current.

8. The method of claim 1 wherein the at least one charge applying device comprises a first charging bar for applying a positive charging current to the product train in response to the application of a positive ionizing voltage and applies second charging bar for applying a negative charging current to the product train in response to the application of a negative ionizing voltage.

9. An apparatus for electrostatically charging products that form a discontinuous product train of substantially similar products moving in a downstream direction, the apparatus comprising:

means for charging at least one of the products in response to the application of an ionizing voltage;

means for determining a satiation charging current of at least one of the products of the discontinuous product train, the satiation current being that amount of charging current flowing from the means for charging that will deposit substantially maximum charge on the surfaces of at least one product in the time it takes the product to move through the at least one charging device; and means for applying a charging current, that is at least substantially equal to the satiation current, to the product train as the product train moves through the means for applying.

10. The apparatus of claim 9 wherein the means for determining further comprises:

means for measuring the current flowing from the means for charging to the at least one product;

means for increasing the ionizing voltage applied to the means for charging at least until the charging current does not substantially increase; and means for determining that the charging current is the satiation current when the charging current does not substantially increase.

11. The apparatus of claim 9 wherein each of the products comprises a plurality of sheets bound together;

the bound products form a discontinuous product train of substantially similar bound products moving through the at least one charge applying device with a constant velocity; and the means for determining comprises means for determining a satiation current for at least one of the bound products of the discontinuous product train, the satiation current being that amount of charging current that will deposit substantially maximum charge on the surfaces of at least one product in the time it takes the product to move through the at least one charging device.

12. The apparatus of claim 11 wherein the means for determining further comprises means for determining a satiation charging current for multiple bound products of the discontinuous product train and for calculating a satiation charging current that is a function of the satiation charging currents of the multiple bound products; and the means for applying a charging current comprises means for applying a substantially constant charging current, that is at least substantially equal to the calculated satiation current, to the product train as the product train moves through the at least one charge applying device.

13. The apparatus of claim 11 wherein the means for applying a charging current comprises means for substantially continuously applying a substantially constant charging current, that is at least substantially equal to the satiation current, to the product train as the product train moves through the means for applying.

14. The apparatus of claim 9 wherein the means for charging at least one of the products comprises a positive charge applying device, that applies a charging current to the product train in response to the application of a positive ionizing voltage, and a negative charge applying device, that applies a charging current to the product train in response to the application of a negative ionizing voltage; and the product train passes between the positive and negative charge applying devices.

15. The apparatus of claim 9 wherein the means for charging and the means for applying comprise at least one charging bar and a grounded electrode for applying a charging current to the product train in response to application of an ionizing voltage to the charging bar.

16. A method of electrostatically tacking together plural continuous webs of material moving at substantially the same rate through at least one charge applying device which supplies a charging current in response to the application of an ionizing voltage, the method comprising:

placing a first continuous web against one or more additional continuous webs to thereby form a layered continuous web;

determining a satiation charging current of the layered continuous web, the satiation current being that amount of charging current that will deposit substantially maximum charge on the surfaces of an area of the layered web in the time it takes the area to move through the at least one charging device; and applying a substantially constant charging current to the layered web as the web move through the at least one charge applying device to thereby tack the first continuous web to the one or more additional continuous webs, the charging current being at least substantially equal to the satiation current.

17. The method of claim 16 wherein the step of determining further comprises:

charging the layered continuous web at an ionizing voltage;

measuring the current flowing to layered web during the step of charging;

increasing the voltage applied during the step of charging at least until the charging current does not substantially increase; and determining that the value of the satiation current is the value of the charging current when the charging current does not substantially increase.

18. The method of claim 16 wherein the step of applying further comprises substantially continuously applying a substantially constant charging current to the continuous layered web as the layered web move through the at least one charge applying device, the charging current being at least substantially equal to the satiation current.

19. The method of claim 16 wherein the step of applying further comprises applying a positive charging current to the web in response to the application of a positive ionizing voltage and applying a negative charging current to the web in response to the application of a negative ionizing voltage.

20. An apparatus for electrostatically tacking together adjacent layers of material that form a continuous web comprising:

at least one charge applying device which supplies a charging current in response to the application of an ionizing voltage;

means for determining a satiation charging current of the layered continuous web, the satiation current being that amount of charging current that will deposit substantially maximum charge on the surfaces of an area of the layered web in the time it takes the area to move through the at least one charging device; and means for applying a substantially constant charging current to the layered web as the web moves through the at least one charge applying device to thereby tack together adjacent layers of continuous web, the charging current being at least substantially equal to the satiation current.

* * * * *